US005962398A

United States Patent [19]

Vasudevan

[11] Patent Number: 5,962,398

[45] Date of Patent: Oct. 5, 1999

[54] ISOTROPIC LIQUIDS INCORPORATING ANIONIC POLYMERS WHICH ARE NOT HYDROPHOBICALLY MODIFIED

[75] Inventor: Tirucherai Varahan Vasudevan, West Orange, N.J.

[73] Assignee: Lever Brothers Company, New York, N.Y.

[21] Appl. No.: 08/782,994

[22] Filed: Jan. 14, 1997

[51] Int. Cl.[6] ..... C11D 3/37; C11D 1/12; C11D 1/831; C11D 1/83

[52] U.S. Cl. ..... 510/470; 510/421; 510/422; 510/423; 510/424; 510/472; 510/473; 510/474; 510/476; 510/477; 510/479; 510/417

[58] Field of Search ..... 510/421, 422, 510/423, 424, 470, 472, 473, 474, 476, 477, 479, 417

[56] References Cited

U.S. PATENT DOCUMENTS

| | | | |
|---|---|---|---|
| 4,252,665 | 2/1981 | Casey et al. | 252/106 |
| 4,755,327 | 7/1988 | Bernarducci et al. | 252/547 |
| 4,908,150 | 3/1990 | Hessel et al. | 252/174.12 |
| 5,066,749 | 11/1991 | Leighton et al. | 526/271 |
| 5,073,274 | 12/1991 | Caswell | 252/8.6 |
| 5,174,927 | 12/1992 | Honsa | 252/543 |
| 5,304,323 | 4/1994 | Arai et al. | 252/299.5 |
| 5,308,530 | 5/1994 | Aronson et al. | 252/174.12 |
| 5,332,528 | 7/1994 | Pan et al. | 252/548 |
| 5,719,117 | 2/1998 | Falk et al. | 510/475 |
| 5,723,434 | 3/1998 | Falk et al. | 510/475 |

FOREIGN PATENT DOCUMENTS

| | | |
|---|---|---|
| 0326792 | 8/1989 | European Pat. Off. . |
| 487262 | 5/1992 | European Pat. Off. . |
| 530708 | 3/1993 | European Pat. Off. . |
| 0580245 | 1/1994 | European Pat. Off. . |
| 662511 | 7/1995 | European Pat. Off. . |
| 691398 | 1/1996 | European Pat. Off. . |
| 732394 | 9/1996 | European Pat. Off. . |
| 94/26858 | 11/1994 | WIPO . |
| 95/31528 | 11/1995 | WIPO . |

OTHER PUBLICATIONS

Bagger–Jorgensen, H., et al, "Phase Behavior of a Nonionic Microemulsion upon Addition of Hydrophobically Modified Polyelectrolyte", Langmuir, 11(6), 1934–1941, Jun. 1995.

*Primary Examiner*—Douglas J. McGinty
*Attorney, Agent, or Firm*—Ronald A. Koatz

[57] ABSTRACT

The present invention relates to isotropic liquids containing anionic polymers wherein the polymers are not hydrophobically modified and can still be incorporated into the compositions. By using anionic/nonionic compositions in which more than 25% of nonionic is sugar surfactant, the polymers can be incorporated without such modification.

6 Claims, No Drawings

ISOTROPIC LIQUIDS INCORPORATING ANIONIC POLYMERS WHICH ARE NOT HYDROPHOBICALLY MODIFIED

FIELD OF THE INVENTION

The present invention relates to concentrated (e.g., greater than 20 wt.% surfactant), "isotropic" (non-structured) detergent compositions having pH less than about 8 comprising anionic polymers which are not hydrophobically modified. Specifically, through manipulation of the isotropic surfactant compositions, it is possible to incorporate anionic polymers even though they do not have minimum levels of hydrophobic modification as was previously required by the art for stable incorporation. Further, hydrotropes are also not required.

BACKGROUND OF THE INVENTION

The use of hydrophobically modified anionic polymers in isotropic liquids is taught, for example, in U.S. Pat. No. 5,308,530 to Aronson et al. and in applicants copending application U.S. Ser. No. 08/591,789 to Falk et al., filed Jan. 25, 1996, now U.S. Pat. No. 5,723,434.

In these references, however, the anionic polymer required minimum levels of hydrophobic modification (i.e., ratio of hydrophile to hydrophobe below 10, preferably below 7). The greater the hydrophobic modification (more hydrophobic groups; smaller ratio of hydrophile to hydrophobe), the easier to incorporate the polymer. Such modified polymers, however, can be expensive and difficult to manufacture. Anionic polymers without hydrophobic modification on the other hand, are relatively inexpensive and readily available commercially.

Unexpectedly, applicants have found that, rather than modifying the polymer itself to make it more soluble; or rather than improving solubility using an external agent (i.e., hydrocarbon oil), by merely manipulating the surfactant composition such that sugar surfactant comprises more than 25%, preferably more than 50% of the nonionic component, it is possible to stably incorporate (solubilize) anionic polymer. Preferably, the polymer has a molecular weight under 10,000, more preferably under 8000, more preferably under 6000, more preferably about 4500 and below; more preferably about 3000 and below; and preferably the anionic polymer comprises less than about 1.5%, more preferably less than about 1% of the composition. Solubility will to some extent depend on combination of molecular weight and concentration.

Several prior art references teach compositions somewhat related but clearly different than the compositions of the invention.

EP 0,580,245 (assigned to Colgate), for example, discloses heavy duty liquid compositions containing a mixture of anionic and nonionic surfactants and including a clay softener and a detergency builder (Zeolite), wherein the use of low molecular weight polyacrylic acid (i.e., anionic polymer of MW 500 to 8000 Daltons) as a structurant is taught. Clays are said to be stabilized due to adsorption of the polymer on solids.

This reference fails to teach or suggest specific nonionic surfactants (e.g., sugar surfactants) must comprise part or all of the nonionic component of the surfactant system to obtain stability. In addition, to the extent the anionic polymer is adsorbed onto clays and is not really solubilized, the composition cannot be said to be a true isotropic composition.

EP 0,326,792 A1 (assigned to Monsanto) discloses HDL compositions containing an anionic polymer, e.g., polymeric acetal carboxylates. However, only potassium salt of the polymer is claimed to be soluble in these compositions.

Furthermore, the pH of the compositions are preferred to be about 9 to 9.5 whereas the pH of the invention compositions is below 8.0. Further, these compositions require at least 5 wt.% anionic hydrotropes while the compositions of the present invention do not require hydrotropes. Finally, the reference again fails to teach or suggest the use of a specific surfactant system (i.e., sugar surfactants must comprise part or all of nonionic component) to solubilize the anionic polymers.

U.S. Pat. No. 5,332,528 to Pan et al. discloses detergent compositions containing polyacrylate and polyhydroxy fatty acids amides, a nonionic surfactant that is part of the specific surfactant system of the present invention composition. However, these compositions contain less than 12.5% surfactant. At this level, you don't need sugar and even ethoxylated alcohol would solubilize compared to the concentrated, high surfactant levels (greater than 20%) of the compositions of the invention.

WO 94/26858 (assigned to Unilever) discusses hard surface cleaning compositions containing anionic polymers and having a pH in the range of 2 to 8. These are predominantly nonionic compositions containing less than 3 wt.% anionics. The criticality of using an alkyl polysaccharide as a nonionic surfactant component is not recognized (preferred compositions, in fact, are stated to contain alcohol ethoxylates as nonionic surfactants) and total surfactants are well below the minimum 20% of the compositions of the invention.

U.S. Pat. No. 4,252,665 to Casey et al. discloses hard surface cleaning compositions containing anionic polymers. The surfactant levels of these compositions are very low (lower than 1.5 wt.%) and the pH levels are high (9 to 12).

BRIEF SUMMARY OF THE INVENTION

Surprisingly and unexpectedly, applicants have discovered that in specific concentrated (greater than 20% surfactants) liquid compositions comprising both anionic and nonionic surfactants, if one carefully selects the nonionic surfactant such that minimum percentage of nonionic is a sugar surfactant, then it is possible to stably solubilize non-hydrophobically modified anionic polymers. Anionic polymers having MW under 10,000 Daltons and concentration of anionic polymer under about 1.5% of composition are particularly preferred. Prior to the discovery that a specific selection of nonionic will impart these benefits, it was not possible to solubilize non-hydrophobically modified anionic polymers in a low pH (pH below 8) concentrated, liquid detergent composition comprising anionic and nonionic surfactants.

DETAILED DESCRIPTION OF INVENTION

The present invention relates to specific, concentrated, low pH (i.e., 8 and below) isotropic liquid compositions comprising minimum levels of surfactants and further comprising non-hydrophobically modified anionic polymers. More particularly, by insuring that minimum levels (i.e., about 25% and higher) of all nonionic surfactant present is a sugar nonionic, it is possible to incorporate these non-hydrophobically anionic polymers. This is in contrast to prior art (e.g., U.S. Ser. No. 08/591,789 to Falk et al.) where stable incorporation of such anionic polymers has not been previously obtainable, particularly in concentrated, low pH, isotropic liquids.

While not wishing to be bound by theory, it is believed that the use of more sugar nonionic surfactants provides greater amounts of water, thereby permitting incorporation of polymers more hydrophilic in nature (the anionic polymers) than previously believed possible.

The compositions are described in greater detail below:

Detergent Active

The compositions of the invention contain one or more surface active agents selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants.

Anionic Surfactant Detergents

Anionic surface active agents which may be used in the present invention are those surface active compounds which contain a long chain hydrocarbon hydrophobic group in their molecular structure and a hydrophilic group, i.e. water solubilizing group such as carboxylate, sulfonate or sulfate group or their corresponding acid form. The anionic surface active agents include the alkali metal (e.g. sodium and potassium) water soluble higher alkyl aryl sulfonates, alkyl sulfonates, alkyl sulfates and the alkyl poly ether sulfates. They may also include fatty acids or fatty acid soaps. One of the preferred groups of anionic surface active agents are the alkali metal, ammonium or alkanolamine salts of higher alkyl aryl sulfonates and alkali metal, ammonium or alkanolamine salts of higher alkyl sulfates. Preferred higher alkyl sulfates are those in which the alkyl groups contain 8 to 26 carbon atoms, preferably 10 to 22 carbon atoms and more preferably 12 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$, benzene sulfonate, e.g. sodium linear dodecyl benzene sulfonate. The primary and secondary alkyl sulfates can be made by reacting long chain alpha-olefins with sulfites or bisulfites, e.g. sodium bisulfite. The alkyl sulfates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates.

The alkali metal or ethanolamine alkyl aryl sulfonate can be used in an amount of 0 to 70%, preferably 2 to 50% and more preferably 5 to 20% by weight.

The alkali metal or ethanolamine alkylsulfate can be used in admixture with the alkylbenzene sulfonate in an amount of 0 to 70%, preferably 5 to 50%, more preferably 5 to 20% by weight.

Also normal alkyl and branched chain alkyl sulfates (e.g., primary alkyl sulfates) may be used as the anionic component.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1\text{-}O(CH_2CH_2O)P—SO_3M,$$

where $R^1$ is $C_8$ to $C_{20}$ alkyl, preferably $C_{10}$ to $C_{18}$ and more preferably $C_{12}$ to $C_{15}$; p is 2 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzenesulfonates, or alkyl sulfates.

The alkali metal higher alkyl poly ethoxy sulfate can be used with the alkylbenzene sulfonate and/or with an alkyl sulfate, in an amount of 0 to 70%, preferably 5 to 50% and more preferably 5 to 20% by weight of entire composition.

Nonionic Surfactant

Part of the surfactant composition, according to the subject invention, must be nonionic surfactant. Generally the nonionic surfactant, whether sugar surfactant or not, should comprise about 10% to 100%, preferably 20 to 50% of the total surfactant composition.

In addition at least 25% of the nonionic surfactant should comprise sugar surfactant (e.g., glycoside surfactant).

Sugar or glycoside surfactants suitable for use in accordance with the present invention include those of the formula:

$$RO—R^1O—_y(Z)_x$$

wherein R is a monovalent organic radical containing from about 6 to about 30 (preferably from about 8 to about 18) carbon atoms ($C_{6-C30}$ saturated or unsaturated, branched or unbranched alkyl group) $R^1$ is a divalent hydrocarbon radical containing from about 2 to 4 carbons atoms; 0 is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4).

Alkyl polyglycosides are discussed in the following patents: U.S. Pat. No. 5,573,707 to Cole et al., U.S. Pat. No. 5,562,848 to Wofford et al., U.S. Pat. No. 5,542,950 Cole et al., WO 96/15305 to Cole et al., U.S. Pat. No. 5,5529,122 to Thach, WO 95/33036 to Urfer et al., and DE 4,234,241 to Schmidt. These references are hereby incorporated by reference into the subject application.

Nonionic surfactants which may be used include polyhydroxy amides as discussed in U.S. Pat. No. 5,312,954 to Letton et al. and aldobionamides such as disclosed in U.S. Pat. No. 5,389,279 to Au et al., both of which are hereby incorporated by reference into the subject application.

Another class of sugar based surfactants which can be used include N-alkoxy or N-aryloxy polyhydroxy fatty acid amides discussed in WO 95/07256 to Schiebel et al., WO 92/06071 to Connor et al., and WO 92/06160 to Collins et al. These references are incorporated by reference into the subject application.

Yet another class of sugar based surfactants are sugar esters discussed in GB 2,061,313, GB 2,048,670, EP 20122 and U.S. Pat. No. 4,259,202 to Tanaka et al. These references are again incorporated by reference into the subject application.

Besides the sugar surfactants, other nonionic surfactants are described below:

As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic surfactants are polyalkoxylated lipophiles wherein the desired hydrophile-lipophile balance is obtained from addition of a hydrophilic poly-lower alkoxy group to a lipophilic moiety. A preferred class of nonionic surfactant is the alkoxylated alkanols wherein the alkanol is of 9 to 18 carbon atoms and wherein the number of moles of alkylene oxide (of 2 or 3 carbon atoms) is from 3 to 12. Of such materials it is preferred to employ those wherein the alkanol is a fatty alcohol of 9 to 11 or 12 to 15 carbon atoms and which contain from 5 to 8 or 5 to 9 alkoxy groups per mole.

Exemplary of such compounds are those wherein the alkanol is of 10 to 15 carbon atoms and which contain about 5 to 9 ethylene oxide groups per mole, e.g. Neodol 25-9 and Neodol 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1$^{(R)}$ series of surfactants manufactured by Shell Chemical Company.

Other useful nonionics are represented by the commercially well known class of nonionics sold under the trademark Plurafac by BASF. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol or Neodol trademark: Dobanol 91-5 is an ethoxylated $C_9$–$C_{11}$, fatty alcohol with an average of 5 moles ethylene oxide and Dobanol 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 6 to 9 moles, and the $C_9$ to $C_{11}$ fatty alcohols ethoxylated with about 5–6 moles ethylene oxide.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

If included, cationics may comprise 0–20%, preferably 1–10% by weight of the total composition.

Amphoteric Surfactants

Ampholytic synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino)propane-1-sulfonate, sodium 2-(dodecylamino)ethyl sulfate, sodium 2-(dimethylamino) octadecanoate, disodium 3-(N-carboxymethyidodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of active used may vary from 1 to 85% by weight, preferably 10 to 50% by weight, more preferably 5–20% by weight.

As noted the preferred surfactant systems of the invention are mixtures of anionic and nonionic surfactants.

Builders/Electrolytes

Builders which can be used according to this invention include conventional alkaline detergency builders, inorganic or organic, which should be used at levels from about 0% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1, 1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No 3,308,067.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, tartrate disuccinate and mixtures thereof (TMS/TDS).

Certain zeolites or aluminosilicates can be used. One such aluminosilicate which is useful in the compositions of the invention is an amorphous water-insoluble hydrated compound of the formula $Na_x(_yAlO_2.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 5.0, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Enzymes

One or more enzymes as described in detail below, may optionally be used in the compositions of the invention.

If a lipase is used, the lipolytic enzyme may be either a fungal lipase producible by *Humicola lanuginosa* and *Thermomyces lanuginosus*, or a bacterial lipase which show a positive immunological cross-reaction with the antibody of the lipase produced by the microorganism *Chromobacter viscosum* var. *lipolyticum* NRRL B-3673. This microorganism has been described in Dutch patent specification 154, 269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. KO Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immunodiffusion procedure according to Ouchterlony (Acta. Med. Scan., 133, pages 76–79 (1950).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0: antigen in complete Freund's adjuvant day 4: antigen in complete Freund's adjuvant day 32: antigen in incomplete Freund's adjuvant day 60: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipases showing a positive immunological cross-reaction with the TJ-lipase antibody as hereabove described are lipases suitable in this embodiment of the invention. Typical examples thereof are the lipase ex *Pseudomonas fluorescens* IAM 1057 available from Amano Pharmaceutical Co., Nagoya, Japan, under the trade-name Amano-P lipase, the lipase ex *Pseudomonas fragi* FERM P 1339 (available under the trade-name Amano-B), the lipase ex *Pseudomonas nitroreducens* var. *lipolyticum* FERM P1338, the lipase ex Pseudomonas sp. available under the trade-name Amano CES, the lipase ex *Pseudomonas cepacia*, lipases ex *Chromobacter viscosum*, e.g. *Chromo-*

*bacter viscosum* var. *lipolyticum* NRRL B-3673, commercially available from Toyo Jozo Co., Tagata, Japan; and further Chromobacter viscosum lipases from U.S. Biochemical Corp. USA and Diosynth Co., The Netherlands, and lipases ex *Pseudomonas gladioli.*

An example of a fungal lipase as defined above is the lipase ex *Humicola lanuginosa*, available from Amano under the tradename Amano CE; the lipase ex *Humicola lanuginosa* as described in the aforesaid European Patent Application 0,258,068 (NOVO), as well as the lipase obtained by cloning the gene from *Humicola lanuginosa* and expressing this gene in *Aspergillus oryzae*, commercially available from NOVO industri A/S under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/mi when the formulation is dosed at a level of about 0.1–10, more preferably 0.5–7, most preferably 1–2 g/liter.

A Lipase Unit (LU) is that amount of lipase which produces 1/$\mu$mol of titratable fatty acid per minute in a pH stat under the following conditions: temperature 30° C.; pH=9.0; substrate is an emulsion of 3.3 wt.% of olive oil and 3.3% gum arabic, in the presence of 13 mmol/1 $Ca^{2+}$ and 20 mmol/1 NaCl in 5 mmol/1 Tris-buffer.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B licheniformis*. Examples of suitable commercially available proteases are Alcalase, Savinase, Esperase, all of NOVO Industri a/S; Maxatase and Maxacal of Gist-Brocades; Kazusase of Showa Denko; BPN and BPN' proteases; Optimase from Solvay and so on. The amount of proteolytic enzyme, included in the composition, ranges from 0.05–50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way by specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with co-factors required to promote enzyme activity, i.e., they may be used in enzyme systems, if required. It should also be understood that enzymes having mutations at various positions (e.g., enzymes engineered for performance and/or stability enhancement) are also contemplated by the invention.

One example of an engineered commercially available enzyme is Durazym® from Novo.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used in propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propane diol which is preferred), ethylene glycol, glycerol, sorbitol, mannitol and glucose. The polyol generally represents from about 0.1 to 25% by weight, preferably about 1.0% to about 15%, more preferably from about 2% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One preferred stabilization system is a polyol in combination with boric acid. Preferably, the weight ratio of polyol to boric acid added is at least 1, more preferably at least about 1.3.

Another preferred stabilization system is the pH jump system such as is taught in U.S. Pat. No. 5,089,163 to Aronson et al., hereby incorporated by reference into the subject application.

Optional Ingredients

In addition to the enzymes mentioned above, a number of other optional ingredients may be used.

Alkalinity buffers which may be added to the compositions of the invention include monoethanolamine, triethanolamine, borax and the like.

Other materials such as clays, particularly of the water-insoluble types, may be useful adjuncts in compositions of this invention. Particularly useful is bentonite. This material is primarily montmorillonite which is a hydrated aluminum silicate in which about ⅙th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent No. 401, 413 to Marriott and British Patent No. 461,221 to Marriott and Guam.

In addition, various other detergent additives or adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Optical brighteners for cotton, polyamide and polyester fabrics can be used. Suitable optical brighteners include Tinopal LMS-X, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicon compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

Also, soil release polymers and cationic softening agents may be used.

Anionic Polymer

Anionic polymers of the invention are those polymers that have negatively charged groups attached covalently to the chain. Examples of synthetic anionic polymers are polyacrylic acid units in its partially and fully ionized forms, polyethylene sulfonic acid in its partially and fully ionized forms, poly(methacrylic acid) in its partially and fully ionized forms, poly(phosphoric acid) and its salts, poly (vinylsulfuric acid) and poly(vinyl alcohol-co-vinyl sulfuric acid) and their salts. A list of other synthetic anionic polymers can be found in, "Water-soluble Synthetic Polymers: Properties and Behavior" by P. Moleneux, Vol. II, CRC Press, 1985. This reference is hereby incorporated by reference into the subject application. Examples of commercially available synthetic anionic polymers are Sokalan series and Acusol series of polyacrylic acids and copolymers of acrylic and maleic acids from BASF and Rohm & Haas respectively.

Examples of unmodified and modified natural anionic polymers are alginic acid and its salts and modified starches such as carboxymethyl cellulose. A list of unmodified and modified natural anionic polymers can be found in, "Encyclopedia of Polymers and Thickeners" by R. Y. Lochhead and W. R. Fron in Cosmetics and Toiletries, Vol, 108, May 1993. This reference is also hereby incorporated by reference into the subject application.

The anionic polymer should be used in an amount comprising 0.1 to 10% by wt., preferably 0.25% to 5% by wt. of the composition.

Other optimal ingredients which may be used are hydrotropes.

In general, addition of hydrotropes helps to incorporate higher levels of surfactants into isotropic liquid detergents than would otherwise be possible due to phase separation of surfactants from the aqueous phase. Hydrotropes also allow a change in the proportions of different types of surfactants, namely anionic, nonionic, cationic and zwitterionic, without encountering the problem of phase separation. Thus, they increase the formulation flexibility. Hydrotropes function through either of the following mechanisms: i) they increase the solubility of the surfactant in the aqueous phase by changing the solvent power of the aqueous phase; short chain alcohols such as ethanol, isopropanol and also glycerol and propylene glycol are examples in this class and ii) they prevent formation of liquid crystalline phases of surfactants by disrupting the packing of the hydrocarbon chains of the surfactants in the micelles; alkali metal salts of alkyl aryl sulfonates such as xylene sulfonate, cumene sulfonate and alkyl aryl disulfonates such as DOWFAX® family of hydrotropes marketed by Dow Chemicals are examples in this class.

Preferred hydrotropes in the compositions of the present invention are polyols, which may also act as enzyme stabilizers, such as propylene glycol, ethylene glycol, glycerol, sorbitol, mannitol and glucose.

The following examples are intended to clarify the invention further and are not intended to limit the invention in any way.

All percentages are intended to be percentages by weight, unless stated otherwise.

Materials

Surfactants

Linear alkylbenzene sulfonic acid (LAS acid) was purchased from Vista Chemicals; alcohol ethoxy sulfate (AES; Neodol 25-3S) and ethoxylated alcohols (Neodol 25-9) were purchased from Shell Chemicals. Sugar surfactant alkylpolyglycoside (APG) of different chain lengths were supplied by Henkel Corp. Coco-lactobionamide was prepared in house. It can be prepared as described in U.S. Pat. No. 5,389,279 to Au et al.

Polymers

Polyacrylates of molecular weight (MW) 2500 and 15,000 Daltons (Sokolan PA 20 and Sokalan PA 40) were supplied by BASF. Polyacrylate of 4500 Daltons were provided by Rohm & Haas. Acrylate maleate copolymer of MW 12,000 Daltons (Sokalan CP 9) was supplied by BASF.

Hydrotropes

Sodium Cumene sulfonate (SCS) and sodium xylene sulfonate (SXS) were supplied by Stepan Chemicals and propylene glycol was purchased from Fisher Scientific.

Other Reagents

Sorbitol was supplied as a 70 wt.% aqueous solution by ICI Americas,sodium borate 10 aq., sodium citrate 2 aq. and glycerol were purchased from Fisher Scientific.

Methods

The formulations were prepared by adding to water, sodium citrate, sorbitol, borate, hydrotrope and sodium hydroxide in a beaker and stirred at 35–50° C. until the solution became clear. This was followed by the addition of LAS acid and Neodol 25–9. The mixture was then cooled at 25° C. and the desired amount of Neodol 25–3S (59% active) was added. Required amount of polymer was then added to the base formulation at room temperature (18–23° C.).

Comparative

Solubility of PAA 4500 in ethoxylated alcohol compositions

Composition of Base Formulation

| Component | Wt. % | Remarks |
|---|---|---|
| LAS | 2.7 to 8.0 | ↑ |
| Ethoxylated alcohol, $EO_9$ | 2.7 to 8.0 | Surfactant |
| AES | 4.6 to 14.0 | ↓ |
| Total surfactants | 10.0 to 30.0 | |
| Sodium borate 10 aq. | 4.0 | Enzyme stabilizer |
| Sorbitol | 4.5 | ↑ |
| Glycerol | 2.7 | Enzyme stabilizer hydrotrope |
| Propylene glycol | 4.5 | ↓ |
| Sodium citrate 2 aq. | 2.5 | Sequestrant |
| Ethanol | 1.1 to 3.3 | Solvent present in AES raw material |
| Minors (optional) | 2.0 | Enzymes, fluorescer, perfume, etc. |
| PAA 4500 | 0.17 to 0.83 | Anti-redep. polymer |
| Water | to 100 | |

Note:
i) AES to ethanol ratio (w/w) was constant at 4.2
ii) LAS:$EO_9$:AES (w/w) was constant at 5:3:3

| PAA 4500 concentration | Total Surfactant concentration wt. | | | | |
|---|---|---|---|---|---|
| wt % | 10.0 | 15.0 | 20.0 | 25.0 | 30.0 |
| 0.225 | Soluble | Soluble | Soluble | Insoluble | Insoluble |
| 0.450 | Soluble | Soluble | Insoluble | Insoluble | Insoluble |
| 1.125 | Soluble | Insoluble | Insoluble | Insoluble | Insoluble |

This example shows that, in formulations containing ethoxylated alcohol, $EO_9$, as the nonionic surfactant, polyacrylate of molecular weight about 4500 is not soluble in compositions containing higher than 20 wt.% surfactant, even at levels as low as 0.225% by weight.

While the polymers are soluble in lower surfactant concentration (i.e., 10% or 15%), this is of no value in typical detergent compositions where surfactants comprise greater than 20% to 85%, preferably greater than 20% (e.g. 21%) to 40% of the composition. Solubility at 10% or 15% surfactant concentration (except at concentration of 1.125%) is believed related to the fact that there is more available water in the composition.

COMPARATIVE & EXAMPLE 1 & 2

Solubility of PAA 4500 in compositions containing ethoxylated alcohol or sugar-based surfactant as the nonionic component.

Composition of Base Formulation

| Component | Wt. % | Remarks |
|---|---|---|
| LAS | 8.0 | ↑ |
| Nonionic surfactant* | 8.0 | Surfactant |
| AES | 14.0 | ↓ |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |

-continued

Composition of Base Formulation

| Component | Wt. % | Remarks |
|---|---|---|
| Propylene glycol | 4.5 | ↓ |
| Sodium citrate 2 aq. | 2.5 | Sequestrant |
| Ethanol | 3.3 | Solvent present in AES raw material |
| Minors (optional) | 2.0 | Enzymes, fluorescer, perfume, etc. |
| PAA 4500 | 0.225 to 1.125 | Anti-redep. polymer |
| Water | to 100 | |

*$EO_9$ or sugar surfactant

| | Comparative | Example 1 | Example 2 |
|---|---|---|---|
| | Nonionic Surfactant | | |
| PAA 4500 concn. wt. % | $EO_9$ Actives | APG ($C_{12}$–$C_{14}$) | Coco-lactobionamide |
| 0.225 | Insoluble | Soluble | Soluble |
| 0.450 | Insoluble | Insoluble | Insoluble |
| 1.125 | Insoluble | Insoluble | Insoluble |

This example shows that PAA at 0.225 wt.% is insoluble in formulations containing ethoxylated alcohol, $EO_9$ as the nonionic surfactant but is soluble in formulations containing sugar-based surfactant such as APG or coco-lactobionamide as the nonionic surfactant. At 0.45 wt.% and higher concentration, PAA 4500 is not soluble in any of the compositions tested.

EXAMPLE 3

Effect of molecular weight on PAA solubility

Composition of Base Formulation

| Component | Wt. % | Remarks |
|---|---|---|
| LAS | 8.0 | ↑ |
| APG ($C_{12}$–$C_{14}$) | 8.0 | Surfactant |
| AES | 14.0 | ↓ |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 2.5 | Sequestrant |
| Ethanol | 3.3 | Solvent present in AES raw material |
| Minors (optional) | 2.0 | Enzymes, fluorescer, perfume, etc. |
| PAA 4500 | 0.225 to 1.125 | Anti-redep. polymer |
| Water | to 100 | |

| PAA concn. wt. % | 2500 | 4500 | 1500 |
|---|---|---|---|
| 0.225 | Soluble | Soluble | Insoluble |
| 0.450 | Soluble | Insoluble | Insoluble |
| 1.125 | Soluble | Insoluble | Insoluble |

This example shows that PAA solubility is inversely proportional to its molecular weight. At higher than 0.45 wt.% level, PAA of molecular weight 4500 or higher is insoluble.

EXAMPLE 4

Effect of surfactant composition on PAA 4500 solubility

Composition of Base Formulation

| Component | Wt. % | Remarks |
|---|---|---|
| LAS | 0.0–12.0 | ↑ Surfactant |
| APG ($C_1$–$C_{14}$) | 8.8–15.0 | |
| AES | 8.0–22.5 | |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 2.5 | Sequestrant |
| Ethanol | 1.15 to 3.3 | Solvent present in AES raw material |
| Minors (optional) | 2.0 | Enzymes, fluorescer, perfume, etc. |
| HMPAA | 0.225 to 1.125 | Anti-redep. polymer |
| Water | to 100 | |

Note: AES to ethanol ratio (w/w) was constant at 4.2.

| PAA concn. | LAS:APG ($C_{12}$–$C_{14}$):AES | | | | |
|---|---|---|---|---|---|
| wt. % | 5:3:3 | 4:3:3 | 3:3:5 | 0:1:1 | 0:1:3 |
| 0.225 | Insoluble | Insoluble | Soluble | Soluble | Insoluble |
| 0.450 | Insoluble | Insoluble | Insoluble | Insoluble | Insoluble |
| 1.125 | Insoluble | Insoluble | Insoluble | Insoluble | Insoluble |

This example shows that PAA 4500 is not soluble in high LAS or very high AES compositions.

EXAMPLE 5

Effect of citrate concentration on the solubility of PAA 4500

Composition of Base Formulation

| Component | Wt. % | Remarks |
|---|---|---|
| LAS | 8.0 | ↑ |
| APG ($C_{12}$–$C_{14}$) | 8.0 | Surfactant |
| AES | 14.0 | ↓ |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 0–10.0 | Sequestrant |
| Ethanol | 3.3 | Solvent present in AES raw material |
| Minors (optional) | 2.0 | Enzymes, fluorescer, perfume, etc. |
| PAA 4500 | 0.225 | Anti-redep. polymer |
| Water | to 100 | |

| Sod. citrate 2 aq. Wt. % | PAA 4500 Solubility |
|---|---|
| 0.0 | Soluble |
| 2.5 | Soluble |
| 5.0 | Soluble |

This example shows that in the range tested, there is no effect of citrate concentration on PAA 4500 solubility.

EXAMPLE 6

Solubility of acrylate maleate copolymer of molecular weight 12,000

Composition of Base Formulation

| Component | Wt. % | Remarks |
|---|---|---|
| LAS | 8.0 | ↑ |
| APG | 8.0 | Surfactant |
| AES | 14.0 | ↓ |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 2.5 | Sequestrant |
| Ethanol | 3.3 | Solvent present in AES raw material |
| Minors (optional) | 2.0 | Enzymes, fluorescer, perfume, etc. |
| Acrylate maleate copolymer | 0.125–0.625 | Anti-redep. polymer |
| Water | to 100 | |

| Polymer concentration. wt. % | Solubility |
|---|---|
| 0.125 | Soluble |
| 0.250 | Soluble |
| 0.625 | Soluble |

This example shows that, in the range tested, an acrylate maleate copolymer of MW 12,000 Daltons is also soluble in APG containing formulations.

We claim:

1. An isotropic liquid detergent composition consisting essentially of, by weight:

(a) about 22% to about 50% of the total composition as anionic surfactant selected from the group consisting of alkyl sulfonates, alkyl sulfates, polyalkoxysulfates, and mixtures thereof;

(b) about 10% to about 63% of the total composition as nonionic surfactant, wherein at least about 25% of said nonionic surfactant is a sugar surfactant;

(c) optionally one or more of cationic, amphoteric, or zwitterionic surfactants;

(d) up to about 20% of the total composition as electrolyte;

(e) a non-hydrophobically modified anionic polymer; and (f) water;

wherein the total amount of all surfactant in the composition is no more than about 85%.

2. A composition according to claim 1, wherein anionic polymer has MW of 10,000 and below.

3. A composition according to claim 2, wherein MW is about 6000 and below.

4. A composition according to claim 1, wherein anionic polymer is less than about 1.5% of the composition.

5. A composition according to claim 4, wherein anionic polymer is about 0.5% and below.

6. A composition according to claim 1, wherein the sugar surfactant is selected from the group consisting of:

(a) sugar or glycoside surfactants having formula:

$$ROR'O_y(Z)_x$$

wherein R is monovalent $C_6$ to $C_{30}$ organic radical;

R' is divalent hydrocarbon radical of about 2 to 4 carbons;

O is oxygen;

y is a number of average value of 0 to 12;

z is derived from 5 or 6 carbon containing reducing sugar; and x is average 1 to about 10;

(b) alkyl polyglycosides;

(c) polyhydroxy fatty acid amides; and (d) aldobionamides.

* * * * *